US009620058B2

(12) United States Patent
Lee

(10) Patent No.: US 9,620,058 B2
(45) Date of Patent: Apr. 11, 2017

(54) ORGANIC LIGHT EMITTING DISPLAY DEVICE AND METHOD FOR DRIVING THE SAME

(71) Applicant: Samsung Display Co., Ltd., Yongin, Gyeonggi-Do (KR)

(72) Inventor: Wook Lee, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 218 days.

(21) Appl. No.: 14/446,879

(22) Filed: Jul. 30, 2014

(65) Prior Publication Data

US 2015/0042630 A1 Feb. 12, 2015

(30) Foreign Application Priority Data

Aug. 12, 2013 (KR) ..... 10-2013-0095327

(51) Int. Cl.
*G09G 3/3208* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2320/0295* (2013.01); *G09G 2320/041* (2013.01)

(58) Field of Classification Search
CPC ..... G09G 2320/041; G09G 3/3208; G09G 3/32–3/3291
See application file for complete search history.

(56) References Cited

U.S. PATENT DOCUMENTS

| | | | | |
|---|---|---|---|---|
| 8,102,337 | B2 | 1/2012 | Senda et al. | |
| 8,299,986 | B2 | 10/2012 | Senda et al. | |
| 8,421,719 | B2 | 4/2013 | Senda et al. | |
| 2005/0017934 | A1* | 1/2005 | Chung | G09G 3/3233 345/82 |
| 2005/0285825 | A1* | 12/2005 | Eom | G09G 3/3233 345/76 |

(Continued)

FOREIGN PATENT DOCUMENTS

| | | | |
|---|---|---|---|
| JP | 2008-181008 | A | 8/2008 |
| KR | 10-2010-0097689 | A | 9/2010 |
| KR | 10-2011-0006861 | A | 1/2011 |

*Primary Examiner* — Kumar Patel
*Assistant Examiner* — Amy C Onyekaba
(74) *Attorney, Agent, or Firm* — Robert E. Bushnell, Esq.

(57) ABSTRACT

An organic light emitting display device includes pixels, a data driver, a scan driver, a control line driver and a temperature estimating unit. The pixels are respectively disposed at intersection portions of data lines, scan lines, sensing control lines and emission control lines. The data driver supplies data signals to the data lines. The scan driver progressively supplies a scan signal to the scan lines. The control line driver progressively supplies a sensing control signal to the sensing control lines during a temperature sensing period, and progressively supplies an emission control signal to the emission control lines during a normal driving period. The temperature estimating unit estimates temperatures of the pixels according to the amplitudes of currents supplied from the pixels through data lines during the temperature sensing period.

11 Claims, 3 Drawing Sheets

(56) References Cited

U.S. PATENT DOCUMENTS

| | | | | |
|---|---|---|---|---|
| 2006/0139253 | A1* | 6/2006 | Choi | G09G 3/3233 345/76 |
| 2008/0150847 | A1* | 6/2008 | Kim | G09G 3/3233 345/82 |
| 2008/0158218 | A1* | 7/2008 | Kim | G09G 3/3225 345/212 |
| 2008/0246702 | A1* | 10/2008 | Lee | G09G 3/3233 345/77 |
| 2009/0027315 | A1* | 1/2009 | Kim | G09G 3/3233 345/76 |
| 2009/0027374 | A1* | 1/2009 | Kohno | G09G 3/3233 345/212 |
| 2009/0033685 | A1* | 2/2009 | Park | G09G 3/3233 345/690 |
| 2009/0121987 | A1 | 5/2009 | Fukutome et al. | |
| 2009/0184901 | A1* | 7/2009 | Kwon | G09G 3/3233 345/77 |
| 2011/0254871 | A1* | 10/2011 | Yoo | G09G 3/3233 345/690 |
| 2012/0139955 | A1 | 6/2012 | Jaffari et al. | |
| 2014/0104259 | A1* | 4/2014 | Oh | G09G 3/3266 345/212 |

* cited by examiner

ORGANIC LIGHT EMITTING DISPLAY DEVICE AND METHOD FOR DRIVING THE SAME

CLAIM OF PRIORITY

This application claims priority to and the benefit of Korean Patent Application No. 10-2013-0095327, filed on Aug. 12, 2013, in the Korean Intellectual Property Office, the entire contents of which are incorporated herein by reference in their entirety.

BACKGROUND OF THE INVENTION

Field of the Invention

The present invention relates to an organic light emitting display device and a method for driving the same.

Description of the Related Art

Recently, there have been developed various types of flat panel display devices capable of reducing the weight and volume of cathode ray tubes, which are disadvantages. The flat panel display devices include a liquid crystal display device, a field emission display device, a plasma display panel, an organic light emitting display device, and the like.

Among these flat panel display devices, the organic light emitting display device displays images using organic light emitting diodes that emit light through recombination of electrons and holes. The organic light emitting display device has a fast response speed and is driven with low power consumption. In a general organic light emitting display device, a driving transistor included in each pixel supplies current with an amplitude corresponding to a data signal, so that light is generated in an organic light emitting diode.

The characteristic of the organic light emitting diode and the characteristic of a circuit for supplying current to the organic light emitting diode are changed depending on temperature. Accordingly, the luminance of light emitted in the organic light emitting diode can be changed.

SUMMARY OF THE INVENTION

According to an aspect of the present invention, there is provided an organic light emitting display device, including: pixels respectively disposed at intersecting portions of data lines, scan lines, sensing control lines and emission control lines; a data driver configured to supply data signals to the data lines; a scan driver configured to progressively supply a scan signal to the scan lines; a control line driver configured to progressively supply a sensing control signal to the sensing control lines during a temperature sensing period and to progressively supply an emission control signal to the emission control lines during a normal driving period; and a temperature estimating unit configured to estimate temperatures of the pixels according to the amplitudes of currents supplied from the pixels through data lines during the temperature sensing period.

The temperature estimating unit may include: an integrating circuit configured to generate a sensing voltage by integrating the current supplied from each pixel during the temperature sensing period; and a temperature data generating unit configured to read a temperature of each pixel, corresponding to a variation in the sensing voltage, from a lookup table, and output the read temperature as temperature data.

The integrating circuit may include: an amplifier configured to have a first input terminal coupled to a corresponding data line among the data lines, a second input terminal coupled to a reference voltage source, and an output terminal coupled to the temperature data generating unit; a first capacitor coupled between the first input terminal and the output terminal; a second capacitor coupled between the output terminal and a second power source; and a switching element coupled between the first input terminal and the output terminal, the switching element being turned off in response to the sensing control signal.

The current may be supplied from a first power source to the data line through a diode-coupled driving transistor of each pixel.

The control line driver may not supply the emission control signal during the temperature sensing period, and may not supply the sensing control signal during the normal driving period.

The data driver may supply predetermined reference data signals to the data lines during the temperature sensing period.

Each pixel may include: an organic light emitting diode; a first transistor coupled between the first power source and an anode electrode of the organic light emitting diode; a second transistor coupled between the data line and the first power source, the second transistor being turned on in response to the scan signal; a third transistor coupled between gate and drain electrodes of the first transistor, the third transistor being turned on in response to the sensing control signal; a fourth transistor coupled between the drain electrode of the first transistor and the data line, the fourth transistor being turned on in response to the sensing control signal; and a fifth transistor coupled between the drain electrode of the first transistor and the anode electrode of the organic light emitting diode, the fifth transistor being turned on in response to the emission control signal.

The organic light emitting display device may further include a sixth transistor coupled between the data line and the temperature estimating unit, the sixth transistor being turned on in response to the sensing control signal.

According to an aspect of the present invention, there is provided a method for driving an organic light emitting display device, the method including: programming a predetermined data signal in a storage capacitor of a pixel during a first period; and estimating a temperature of the pixel according to the amplitude of current flowing from a first power source to a data line through a diode-coupled driving transistor of the pixel during a second period.

The estimating of the temperature of the pixel may include: generating a sensing voltage by integrating the current during the second period; and reading, from a lookup table, a temperature corresponding to a variation in the sensing voltage.

The method may further include compensating for a data signal supplied from the outside of the organic light emitting display device according to the estimated temperature of the pixel.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components.

In the drawing figures, dimensions may be exaggerated for clarity of illustration. It will be understood that, when an element is referred to as being "between" two elements, it can be the only element between the two elements, or one or more intervening elements may also be present. Like reference numerals refer to like elements throughout.

DETAILED DESCRIPTION

Figure 1:
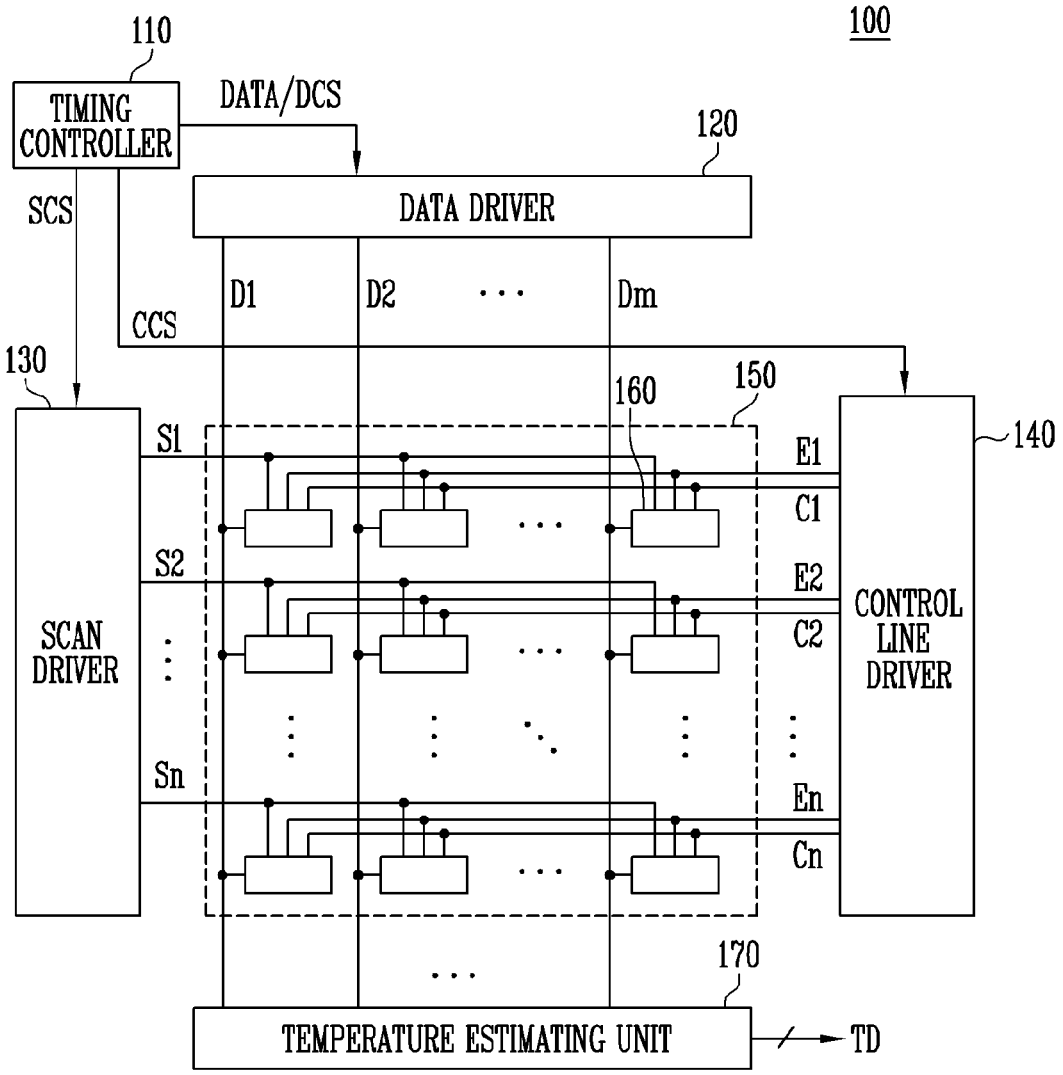
FIG. 1 is a block diagram illustrating an organic light emitting display device according to an embodiment of the present invention.

Hereinafter, certain exemplary embodiments of the present invention will be described with reference to the accompanying drawings. Here, when a first element is described as being coupled to a second element, the first element may be directly coupled to the second element or it may be indirectly coupled to the second element via a third element. Furthermore, some of the elements that are not essential to a complete understanding of the invention are omitted for clarity. Also, like reference numerals refer to like elements throughout.

FIG. 1 is a block diagram illustrating an organic light emitting display device according to an embodiment of the present invention.

Referring to FIG. 1, the organic light emitting display device 100 according to this embodiment includes a timing controller 110, a data driver 120, a scan driver 130, a control line driver 140, a display unit 150 and a temperature estimating unit 170.

The timing controller 110 controls operations of the data driver 120, the scan driver 130 and the control line driver 140 in response to a synchronization signal (not shown) supplied from the outside of the organic light emitting display device. Specifically, the timing controller 110 generates a data driving control signal DCS and supplies the generated data driving control signal DCS to the data driver 120. The timing controller 110 generates a scan driving control signal SCS and supplies the generated scan driving control signal SCS to the scan driver 130. The timing controller 110 generates a control line driving control signal CCS and supplies the generated control line driving control signal CCS to the control line driver 140.

The timing controller 110 supplies, to the data driver 120, data supplied from the outside of the organic light emitting display device. The timing controller 110 may compensate for the data supplied from the outside based on a temperature data TD output from the temperature estimating unit 170.

The data driver 120 realigns the data supplied by the timing controller 110 and supplies the realigned data as data signals to data lines D1 to Dm in response to the data driving control signal DCS output from the timing controller 110.

The data driver 120 supplies, to data lines D1 to Dm, a data signal (DD of FIG. 3A) supplied from the outside, i.e., corresponding to an image to be displayed by the display unit 150, during a normal driving period. The data driver 120 supplies, to the data lines D1 to Dm, a predetermined reference data signal (PD of FIG. 3B) for sensing a temperature during a temperature sensing period.

The scan driver 130 progressively supplies a scan signal to scan lines S1 to Sn in response to the scan driving control signal SCS output from the timing controller 110.

The control line driver 140 progressively supplies a sensing control signal to sensing control lines C1 to Cn and progressively supplies an emission control signal to emission control lines E1 to En, in response to the control line driving control signal CCS output from the timing controller 110.

Specifically, the control line driver 140 progressively supplies the emission control signal to the emission control lines E1 to En during the normal driving period, and progressively supplies the sensing control signal to the sensing control lines C1 to Cn during the temperature sensing period. In addition, the control line driver 140 does not supply the sensing control signal to the sensing control lines C1 to Cn during the normal driving period, and does not supply the emission control signal to the emission control lines E1 to En during the temperature sensing period.

The timing at which the data driver 120, the scan driver 130 and the control line driver 140 supply the data signal or the control signals will be described in detail with reference to FIGS. 3A and 3B.

The display unit 150 includes pixels 160 respectively disposed at intersection portions of the data lines D1 to Dm, the scan lines S1 to Sn, the sensing control lines C1 to Cn and the emission control lines E1 to En. In that regard, the data lines D1 to Dm are arranged along vertical lines, and the scan lines S1 to Sn, the sensing control lines C1 to Cn and the emission control lines E1 to En are arranged along horizontal lines.

Each pixel 160 emits light with luminance corresponding to the data signal supplied from a corresponding data line among the data lines D1 to Dm during the normal driving period.

The temperature estimating unit 170 estimates temperatures of the pixels 160 according to the amplitudes of currents supplied from the pixels 160 through data lines D1 to Dm, and outputs temperature data TD including the temperature of each pixel 160.

The temperature data TD may be applied for various usages. For example, the timing controller 110 compensates for the data supplied from the outside according to the temperature data TD output from the temperature estimating unit 170, thereby preventing the deterioration of image quality caused by temperature.

Specific functions and operations of the pixels 160 and the temperature estimating unit 170 will be described in detail with reference to FIG. 2.

Figure 2:
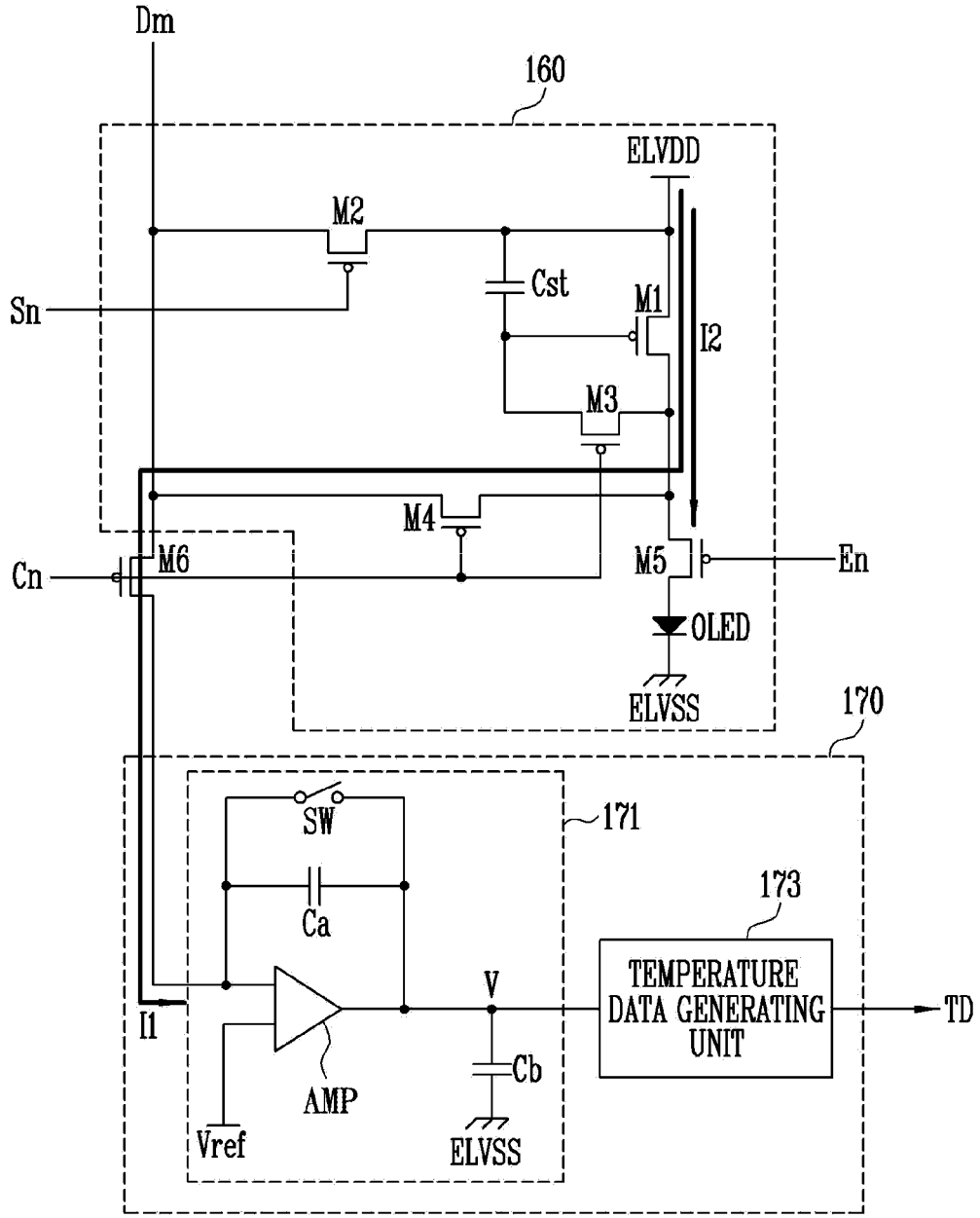
FIG. 2 is a circuit diagram showing in detail a pixel and a temperature estimating unit shown in FIG. 1.

FIG. 2 is a circuit diagram showing in detail the pixel and the temperature estimating unit shown in FIG. 1. For convenience of illustration, a pixel 160 disposed on an n-th row and an m-th column among the plurality of pixels, and only a portion of the temperature estimating unit 170 corresponding to one data line Dm, are shown in FIG. 2.

Referring to FIG. 2, the pixel 160 includes a plurality of transistors M1 to M5, an organic light emitting diode OLED and a storage capacitor Cst.

A first transistor M1 is coupled between a first power source ELVDD and an anode electrode of the organic light emitting diode OLED. The first transistor M1 supplies, to the anode electrode of the organic light emitting diode OLED, current with an amplitude corresponding to a voltage charged in the storage capacitor Cst.

A second transistor M2 is coupled to a data line Dm and to the first power source ELVDD. The second transistor M2 is turned on in response to a scan signal supplied through a scan line Sn. The second transistor M2 charges, in the storage capacitor Cst, a voltage corresponding to a data signal supplied through the data line Dm when the scan signal is supplied through the scan line Sn.

A third transistor M3 is coupled between gate and drain electrodes of the first transistor M1. The third transistor M3 is turned on in response to a sensing control signal supplied through a sensing control line Cn. As the third transistor M3 is turned on when the sensing control signal is supplied through the sensing control line Cn, the first transistor M1 is diode-coupled.

A fourth transistor M4 is coupled between the drain electrode of the first transistor M1 and the data line Dm. The fourth transistor M4 is turned on in response to the sensing control signal supplied through the sensing control line Cn. When the sensing control signal is supplied through the sensing control line Cn, the fourth transistor M4 forms a current path I1 from the first power source ELVDD to the data line Dm through the first transistor M1.

A fifth transistor M5 is coupled between the drain electrode of the first transistor M1 and the anode electrode of the organic light emitting diode OLED. The fifth transistor M5 is turned on in response to an emission control signal supplied through an emission control line En. When the emission control signal is supplied through the emission control line En, the fifth transistor M5 forms a current path 12 from the first power source ELVDD to a second power source ELVSS through the first transistor M1 and the organic light emitting diode OLED.

The organic light emitting diode OLED is coupled between a drain electrode of the fifth transistor M5 and the second power source ELVSS. The organic light emitting diode OLED emits light with a luminance corresponding to current supplied from the first power source ELVDD through the first and fifth transistors M1 and M5.

The storage capacitor Cst is coupled between the gate electrode of the first transistor M1 and the first power source ELVDD. The storage capacitor Cst charges a voltage corresponding to the data signal supplied to the data line Dm when the second transistor M2 is turned on.

According to an embodiment of the invention, the pixel 160 may further include a sixth transistor M6. The sixth transistor M6 may be formed on the data line Dm. The sixth transistor M6 is turned on in response to the sensing control signal supplied through the sensing control line Cn. When the sensing control signal is supplied through the sensing control line Cn, the sixth transistor M6 supplies, to the temperature estimating unit 170, current supplied from the first power source ELVDD through the pixel 160.

According to another embodiment of the invention, the sixth transistor M6 may be formed on the data line Dm between the display unit 160 and the temperature estimating unit 170.

The pixel 160 shown in FIG. 2 represents an embodiment to which the technical spirit of the present invention can be applied. That is, the technical spirit of the present invention is not limited to the pixel 160 shown in FIG. 2.

The temperature estimating unit 170 includes an integrating circuit 171 and a temperature data generating unit 173. The integrating circuit 171 integrates current I supplied from the pixel 160 during the temperature sensing period and generates a sensing voltage V as the integrated result. The integrating circuit 171 includes an amplifier AMP, a first capacitor Ca, a second capacitor Cb and a switching element SW.

The amplifier AMP includes a first input terminal, a second input terminal and an output terminal. The first input terminal is coupled to a corresponding data line among the data lines D1 to Dm. The second input terminal is coupled to a reference voltage source (not shown). The output terminal is coupled to the temperature data generating unit 173.

The first capacitor Ca is coupled between the first input terminal and the output terminal of the amplifier AMP. The second capacitor Cb is coupled between the output terminal of the amplifier AMP and the second power source ELVSS. The switching element SW is coupled between the first input terminal and the output terminal of the amplifier AMP. The switching element SW is turned off in response to the sensing control signal supplied through the sensing control line Cn.

The temperature data generating unit 173 outputs, as the temperature data TD, a temperature of the pixel 160 corresponding to a variation in the sensing voltage V generated by the integrating circuit 171. Specifically, the temperature data generating unit 173 measures a variation in the sensing voltage V during a certain period, reads a temperature corresponding to the measured variation from a lookup table (not shown), and determines the read temperature as the temperature of the pixel 160.

The lookup table stores temperatures corresponding to variations in various voltages. Data stored in the lookup table may be experimentally determined.

Hereinafter, functions and operations of the pixel 160 and the temperature estimating unit 170, shown in FIG. 2, will be described with reference to FIGS. 3A, 3B and 4.

Figure 3A:
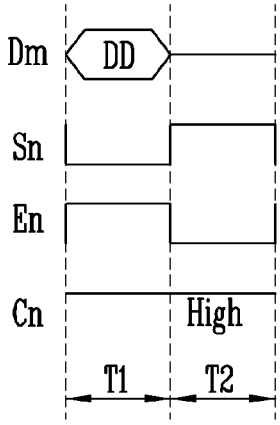
FIG. 3A is a timing diagram of control signals supplied to the pixel and the temperature estimating unit, shown in FIG. 2, during a normal driving period.

FIG. 3A is a timing diagram of control signals supplied to the pixel and the temperature estimating unit, shown in FIG. 2, during the normal driving period. FIG. 3B is a timing diagram of control signals supplied to the pixel and the temperature estimating unit, shown in FIG. 2, during the temperature sensing period. FIG. 4 is a graph showing a change in sensing voltage during the temperature sensing period.

Figure 3B:
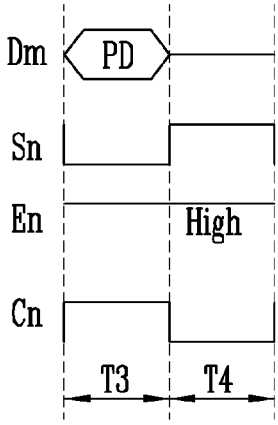
FIG. 3B is a timing diagram of control signals supplied to the pixel and the temperature estimating unit, shown in FIG. 2, during a temperature sensing period.
Figure 4:
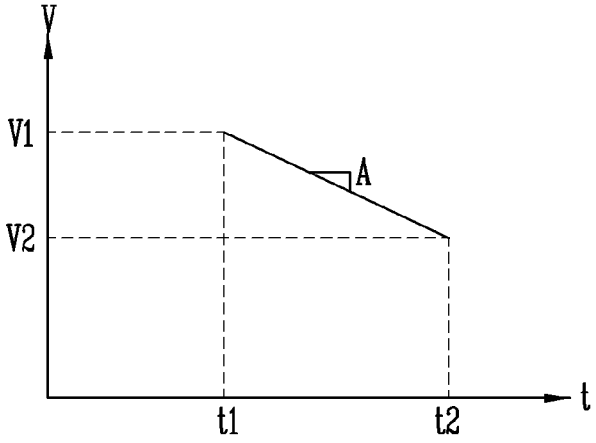
FIG. 4 is a graph showing a change in sensing voltage during the temperature sensing period.

Referring to FIGS. 3A, 3B and 4, the normal driving period is divided into first and second periods T1 and T2, and the temperature sensing period is divided into third and fourth periods T3 and T4.

During the first period T1 in the normal driving period, the data driver 120 of FIG. 1 supplies, to the data line Dm, a data signal DD corresponding to an image to be displayed by the pixel 160. In this case, the scan driver 130 supplies a scan signal to the scan line Sn. As the second transistor M2 of FIG. 2 is turned on in response to the scan signal, a voltage corresponding to the data signal DD is charged in the storage capacitor Cst.

During the second period T2 in the normal driving period, the control line driver 140 of FIG. 1 supplies an emission control signal through the emission control line En. As the fifth transistor M5 of FIG. 2 is turned on in response to the emission control signal, a current path 12 from the first power source ELVDD to the second power source ELVSS through the first transistor M1 and the organic light emitting diode OLED is formed. Current corresponding to the voltage charged in the storage capacitor CST during the first period flows through the current path 12. Accordingly, the organic light emitting diode OLED emits light with a luminance corresponding to the data signal DD of FIG. 3A.

During the third period T3 in the temperature sensing period, the data driver 120 of FIG. 1 supplies, to the data line Dm, a reference data signal PD for sensing a temperature. In this case, the scan driver 130 supplies a scan signal to the scan line Sn. As the second transistor M2 of FIG. 2 is turned on in response to the scan signal, a voltage corresponding to the data signal PD of FIG. 3B is charged in the storage capacitor Cst of FIG. 2.

During the fourth period T4 in the temperature sensing period, the control line driver 140 supplies a sensing control signal through the sensing control line Cn. As the fourth and sixth transistors M4 and M6, respectively, are turned on in response to the sensing control signal, there is formed a current path I1 from the first power source ELVDD to the temperature estimating unit 170 through the first, fourth and sixth transistors M1, M4 and M6.

In this case, the third transistor M3 is also turned on in response to the sensing control signal, and thus the first transistor M1 is diode-coupled. A diode is sensitive to temperature and has a linear characteristic. For example, the amplitude of current flowing through the diode is sensitive to temperature, and is linearly changed. Thus, the current flowing through the current path I1 includes temperature information of the pixel 160. That is, the current flowing through the current path I1 is sensitive to the temperature of the pixel 160, and is linearly changed.

The integrating circuit 171 of the temperature estimating unit 170 integrates the current flowing through the current path I1 and generates a sensing voltage V according to the integrated result. For example, the sensing voltage V, as shown in FIG. 4, is linearly changed from a first voltage V1 to a second voltage V2 during the fourth period T4, i.e., from a first time t1 to a second time t2.

The temperature data generating unit 173 outputs a temperature data TD including the temperature of the pixel 160 according to a variation in the sensing voltage V during the fourth period T4. The temperature data generating unit 173 reads, from the lookup table (not shown), a temperature of the pixel 160 corresponding to the slope A of the sensing voltage V, and outputs the read temperature.

The operation of the organic light emitting display device 100 during the temperature sensing period will be summarized. The predetermined data signal PD supplied from the data driver 120 during the third period T3 is programmed in the storage capacitor Cst of the pixel 160.

Subsequently, current corresponding to the temperature of the pixel 160 flows through the current path I1 formed from the first power source ELVDD to the integrating circuit 171 through a diode-coupled driving transistor, i.e., the first transistor M1, during the fourth period T4. The integrating circuit 171 generates a sensing voltage V by integrating the current supplied through the current path I1 during the fourth period T4. The temperature data generating unit 173 reads, from the lookup table (not shown), a temperature corresponding to the variation in the sensing voltage during the fourth period T4, and outputs the read temperature as the temperature data TD.

By way of summation and review, a method was conventionally used in which a temperature was measured using a separate temperature sensor provided in a pixel circuit, and a data supplied from the outside was compensated according to the measured temperature. However, the method cannot be applied to displays with high resolution.

In the organic light emitting display device and the method for driving the same according to the present invention, the temperature of the pixel can be sensed without using any separate temperature sensor.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics and/or elements described in connection with a particular embodiment may be used singly or in combination with features, characteristics and/or elements described in connection with other embodiments unless otherwise specifically indicated. Accordingly, it will be understood by those of skill in the art that various changes in form and detail may be made without departing from the spirit and scope of the present invention as set forth in the following claims.

What is claimed is:

1. An organic light emitting display device, comprising:

pixels respectively disposed at intersection portions of data lines, scan lines, sensing control lines and emission control lines;

a data driver configured to supply data signals to the data lines;

a scan driver configured to progressively supply a scan signal to the scan lines;

a control line driver configured to progressively supply a sensing control signal to the sensing control lines during a temperature sensing period, and to progressively supply an emission control signal to the emission control lines during a normal driving period; and a temperature estimating unit estimating temperatures of the pixels according to amplitudes of currents supplied from the pixels through data lines during the temperature sensing period.

2. The organic light emitting display device of claim 1, wherein the temperature estimating unit includes:

an integrating circuit configured to generate a sensing voltage by integrating the current supplied from each pixel during the temperature sensing period; and a temperature data generating unit reading a temperature of each pixel, corresponding to a variation in the sensing voltage, from a lookup table, and outputting the read temperature as temperature data.

3. The organic light emitting display device of claim 2, wherein the integrating circuit includes:

an amplifier configured to have a first input terminal coupled to a corresponding data line among the data lines, a second input terminal coupled to a reference voltage source, and an output terminal coupled to the temperature data generating unit;

a first capacitor coupled between the first input terminal and the output terminal of the amplifier;

a second capacitor coupled between the output terminal of the amplifier and a second power source; and a switching element coupled between the first input terminal and the output terminal of the amplifier, the switching element being turned off in response to the sensing control signal.

4. The organic light emitting display device of claim 1, wherein the currents supplied from the pixels are supplied from a first power source to the data line through a diode-coupled driving transistor of each pixel.

5. The organic light emitting display device of claim 1, wherein the control line driver does not supply the emission control signal during the temperature sensing period, and does not supply the sensing control signal during the normal driving period.

6. The organic light emitting display device of claim 1, wherein the data driver supplies predetermined reference data signals to the data lines during the temperature sensing period.

7. The organic light emitting display device of claim 1, wherein each pixel includes:

an organic light emitting diode;

a first transistor coupled between a first power source and an anode electrode of the organic light emitting diode;

a second transistor coupled between the data line and the first power source, the second transistor being turned on in response to the scan signal;

a third transistor coupled between gate and drain electrodes of the first transistor, the third transistor being turned on in response to the sensing control signal;

a fourth transistor coupled between the drain electrode of the first transistor and the data line, the fourth transistor being turned on in response to the sensing control signal; and a fifth transistor coupled between the drain electrode of the first transistor and the anode electrode of the organic light emitting diode, the fifth transistor being turned on in response to the emission control signal.

8. The organic light emitting display device of claim 7, further comprising a sixth transistor coupled between the data line and the temperature estimating unit, the sixth transistor being turned on in response to the sensing control signal.

9. A method for driving an organic light emitting display device, the method comprising the steps of:

programming a predetermined data signal in a storage capacitor of a pixel during a first period; and estimating a temperature of the pixel according to an amplitude of current flowing from a first power source to a data line through a diode-coupled driving transistor of the pixel during a second period.

10. The method of claim 9, wherein the step of estimating the temperature of the pixel includes:

generating a sensing voltage by integrating the current during the second period; and reading, from a lookup table, a temperature corresponding to a variation in the sensing voltage.

11. The method of claim 9, further comprising the step of compensating for a data signal supplied from the outside of the organic light emitting display device according to the estimated temperature of the pixel.

* * * * *